United States Patent [19]

Winter

[11] Patent Number: 4,646,588

[45] Date of Patent: Mar. 3, 1987

[54] PEDESTAL BASE SINGLE LEVER CONTROL UNIT

[75] Inventor: Robert A. Winter, Painesville, Ohio

[73] Assignee: Merriman/Yacht Specialties, Inc., Grand River, Ohio

[21] Appl. No.: 789,454

[22] Filed: Oct. 21, 1985

[51] Int. Cl.[4] ..... B60K 41/02; B60K 41/04

[52] U.S. Cl. ..... 74/876; 74/480 B; 192/0.098

[58] Field of Search ..... 74/480 R, 480 B, 875, 74/876; 192/0.096, 0.098

[56] References Cited

U.S. PATENT DOCUMENTS

| | | | |
|---|---|---|---|
| 2,924,987 | 2/1960 | Pierce | 74/876 |
| 2,986,044 | 5/1961 | Parsons | 74/876 |
| 3,127,785 | 4/1964 | Morse et al. | 192/0.096 X |
| 3,335,618 | 8/1967 | Russey | 74/876 |
| 3,600,978 | 8/1971 | Turner | 74/875 |

*Primary Examiner*—Allan D. Herrmann

*Attorney, Agent, or Firm*—Reising, Ethington, Barnard, Perry & Milton

[57] ABSTRACT

A single lever control head assembly (10) for dual-position-shifting of a transmission and dual position throttle control of a motor includes a support housing (12) and a single lever (62) pivotally supported in a bore (142) in a cylindrical housing (12) for rotation about a lever axis (A). The bore (142) and its axis (A) are offset from the center axis of the cylindrical housing. A throttle arm (16) is rotatably supported by the housing (12) for pivotal movement about a throttle arm axis (B). The transmission arm (20) has a cylindrical female portion (22) rotatably supported by the housing (12) for pivotal movement about a transmission arm axis (A). The transmission arm axis and the lever axis are coaxial. A first connection (26) is disposed within the female portion of the transmission arm (20) and is rotatable about the transmission arm axis for pivoting the transmission arm (20) in an arc about the transmission arm axis to the transmission-engaged position during a first portion of pivotal movement of the lever (62) from the neutral position to either of the transmission-engaged positions. The first connection (26) also maintains the transmission arm (20) in the transmission-engaged positions upon continued movement of the lever (62) to either of the full throttle positions and returns the transmission arm (20) to the neutral position with the lever (62).

23 Claims, 6 Drawing Figures

PEDESTAL BASE SINGLE LEVER CONTROL UNIT

TECHNICAL FIELD

The subject invention relates to single lever control units for controlling and operating the throttle and transmission of an internal combustion engine and, particularly, single lever control units utilized with marine propulsion devices such as an outboard motor and stern drive unit.

BACKGROUND ART

Single lever control units have been used extensively with internal combustion boat engines for marine propulsion systems. This is accomplished by a single lever actuating a throttle linkage and a transmission linkage. In operation, the lever is moved forward or rearward from a neutral position to engage the transmission or shift the engine transmission into forward or reverse, respectively. During the shifting, the throttle remains in an idle condition to prevent wear or damage on the transmission. Upon further movement of the lever forwardly or rearwardly, the throttle is engaged and the speed of the engine is increased.

The disadvantages of such control units is that the connection between the lever and the throttle and transmission linkages requires a large amount of space since some type of gear train is used. Also, none of the support housings can be supported on or in a pedestal post or round column while leaving the required space.

STATEMENT OF THE INVENTION AND ADVANTAGES

The invention includes a single lever control head assembly for dual position shifting of a transmission and dual position throttle control of a motor and comprises a support housing and a single lever means pivotally supported by the housing for rotation about a lever axis. A throttle arm is rotatably supported by the housing for pivotal movement about a throttle arm axis and includes a throttle connection movable in an arc about the throttle arm axis between an idle position and a full throttle position. A transmission arm has a cylindrical female portion rotatably supported by the housing for pivotal movement about a transmission arm axis and includes a transmission connection movable in an arc about the transmission arm axis. The lever means is pivotal in a first direction from a neutral position to a forward transmission engaged position to a full forward throttle position and in an opposite second direction from the neutral position through a reverse transmission engaged position to a full reverse throttle position. The transmission arm axis and the lever axis are coaxial. A first connection means is disposed within the female portion of the transmission arm and rotatable about the transmission arm axis for pivoting the transmission arm in an arc about the transmission arm axis to the transmission engaged positions during a first portion of pivotal movement of the lever means from the neutral position to either of the transmission engaged positions, and for maintaining the transmission arm in the transmission-engaged positions upon continued movement of the lever means to either of the full throttle positions, and for returning the transmission arm to the neutral position with the lever means.

The assembly is further characterized by the housing being cylindrical and sandwiched in a cylindrical pedestal with the lever means supported in a bore offset from the center of the cylindrical housing.

Accordingly, the subject invention may be utilized with existing marine propulsion devices such as outblard motors at a pedestal control station. The subject invention may be sandwiched in a cylindrical pedestal column, thus requiring less floor space. Also, since the lever is coaxial with the transmission arm, the assembly requires less longitudinal space than a gear train. Further, complicated and expensive gear trains are not necessary to actuate the transmission, making the subject invention less costly.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
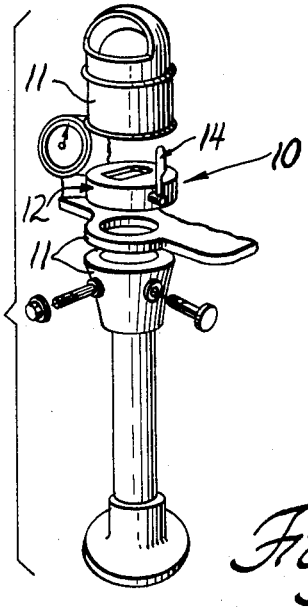
FIG. 1 is a perspective view of the subject invention utilized in a pedestal post.
Figure 2:
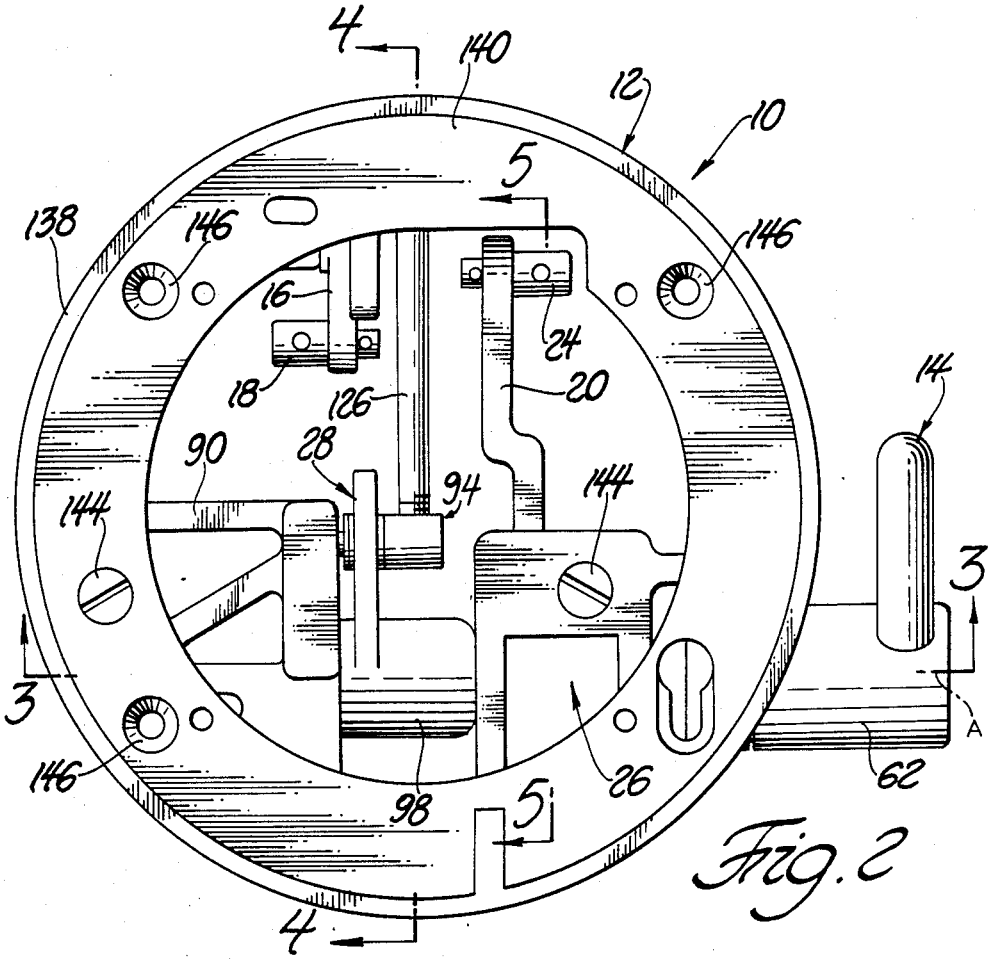
FIG. 2 is a plan view of the subject invention.
Figure 3:
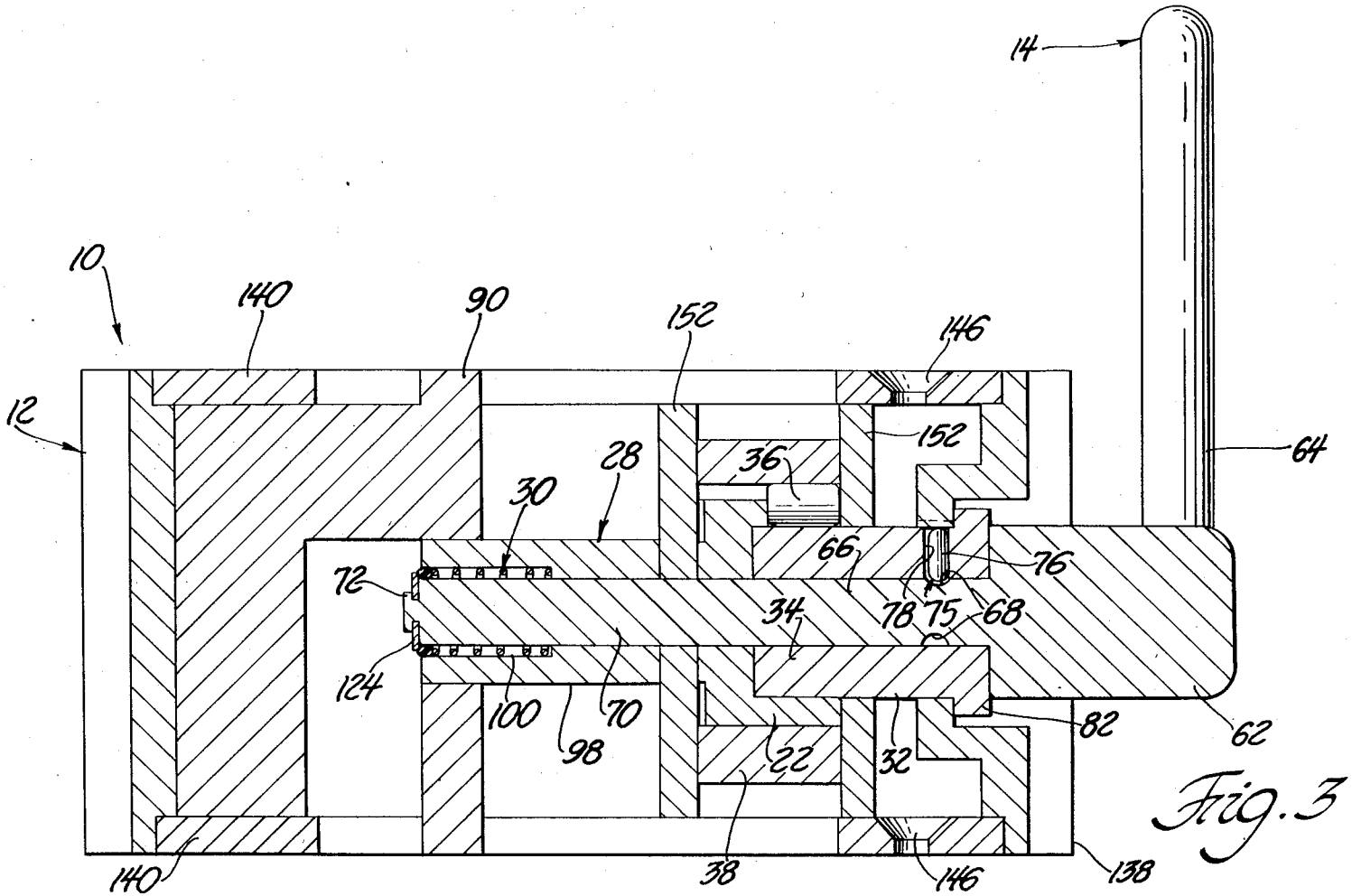
FIG. 3 is a sectional view of the subject invention taken substantially along line 3—3 of FIG. 2.
Figure 4:
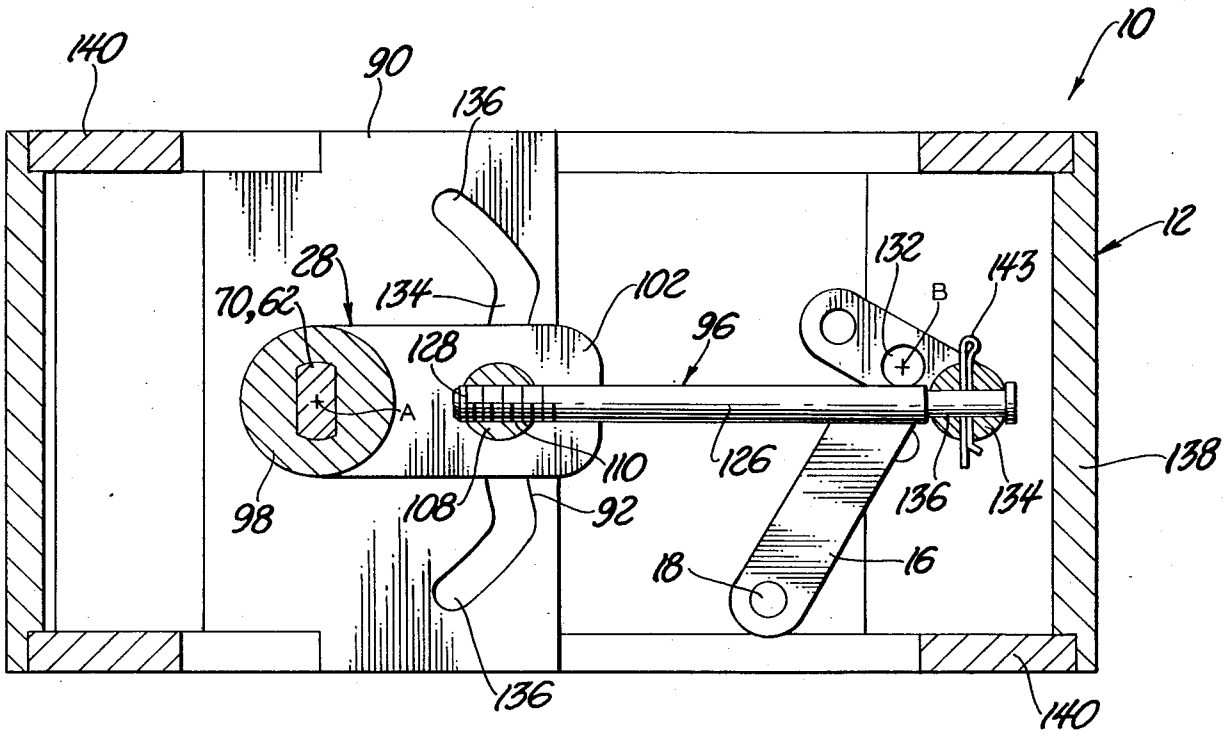
FIG. 4 is a sectional view of the subject invention taken substantially along line 4—4 of FIG. 2.
Figure 5:
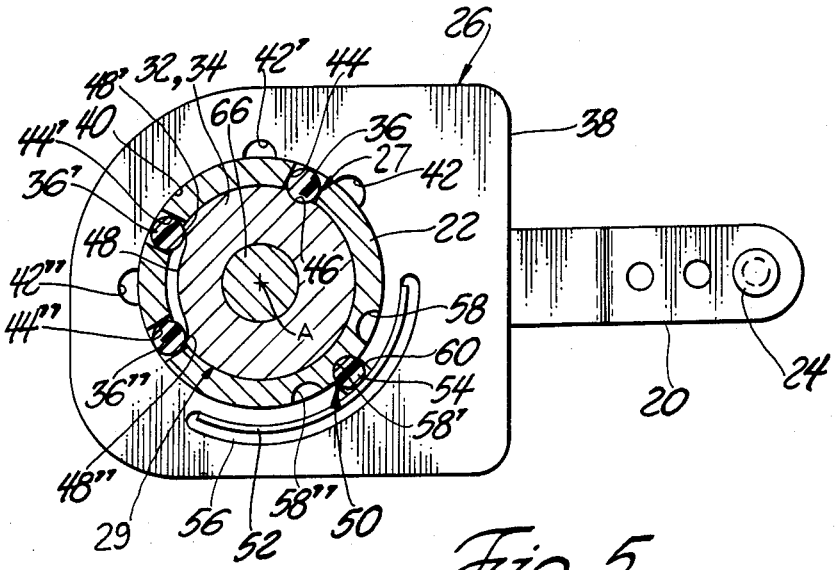
FIG. 5 is a sectional view of the subject invention taken substantially along line 5—5 of FIG. 2.
Figure 6:
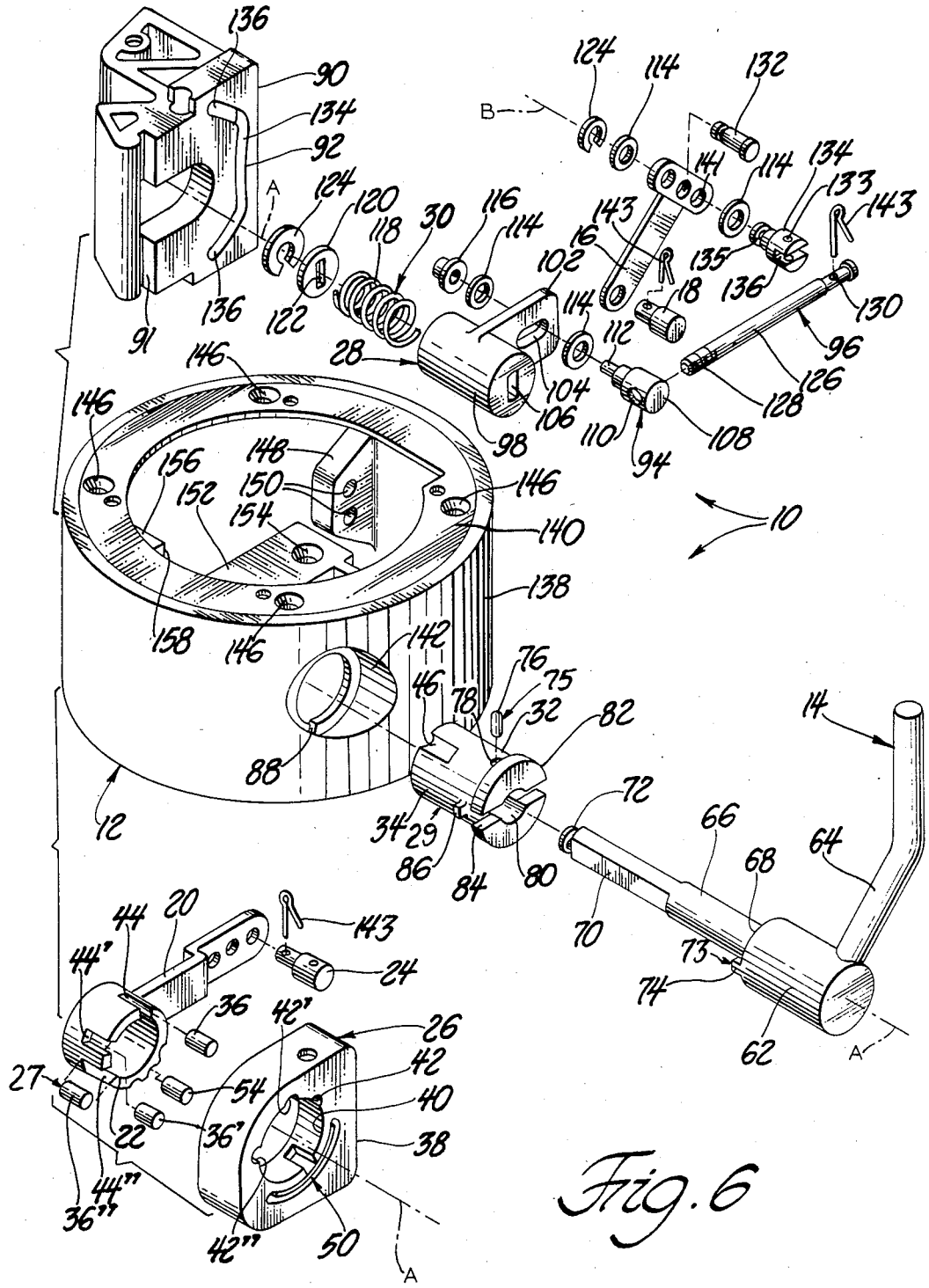
FIG. 6 is an exploded view of the subject invention.

A single lever control head assembly for dual position shifting of a transmission and dual position throttle control of a motor is generally shown at 10. The assembly 10 comprises a support housing, generally indicated at 12, and a single lever means, generally indicated at 14, pivotally supported by the housing 12 for rotation about a lever axis A. The lever means 14 is pivotal in a first direction from a neutral position through a forward transmission-engaged position to a full forward throttle position and in an opposite second direction from the neutral position through a reverse transmission-engaged position to a full reverse throttle position.

The assembly 10 includes a throttle arm 16 rotatably supported by the housing 12 for pivotal movement about a throttle arm axis B and includes a throttle connection 18 movable in an arc about the throttle arm axis B between an idle position and a full throttle position. The assembly 10 also includes a transmission arm 20 having a cylindrical female portion 22 rotatably supported by the housing 12 for pivotal movement about a transmission arm axis A and includes a transmission connection 24 movable in an arc about the transmission arm axis A. The transmission arm axis and lever axis are coaxial, i.e., they are the same axis A. The assembly 10 further includes a first connection means, generally indicated at 26, disposed about the female portion 22 of the transmission arm 20 and rotatable about the transmission arm or lever axis A for pivoting the transmission arm 20 in an arc about the transmission arm or lever axis A to the transmission-engaged positions during a first portion of pivotal movement of the lever means 14 from the neutral position to either of the transmission-engaged positions. The first connection means 26 maintains the transmission arm 20 in the transmission-engaged positions upon continued movement of the lever means 14 to either of the full throttle positions and returns the transmission arm 20 to the neutral position with the lever means 14.

The assembly 10 further includes second connection means, generally indicated at 28, for pivoting the throttle arm 16 in an arc about the throttle arm axis B to the full throttle position in response to pivotal movement of the lever means 14 beyond either of the transmission-engaged positions to the full throttle positions, and for preventing movement of the throttle arm 16 in an arc about the throttle arm axis B to retain the throttle arm 16 in the idle position in respopnse to pivotal movement of the lever means 14 between neutral and the transmission-engaged positions.

The assembly 10 also includes biasing means, generally indicated at 30, for axially biasing the lever means 14 into engagement with the first connection means 26 and allowing disengagement from the first connection means 26 in both the full throttle positions and transmission-engaged positions and allowing the lever means 14 to rotatably pivot in either direction for pivoting the throttle arm 16 in the full throttle position in response to pivotal movement of the lever means 14 beyond either of the transmission-engaged positions to the full throttle positions.

The first connection means 26 includes ball-detent means 27 for engaging and rotating the transmission arm 20 in response to pivotal movement of the lever means 14 during the transmission-engaged positions. Also, the ball-detent means 27 disengages the transmission arm 20 from the lever means 14 in response to pivotal movement of the lever means 14 in the full throttle positions. Put another way, as the lever means 14 is rotated beyond the transmission-engaged positions, the ball-detent means 27 disengages the transmission arm 20 so that the transmission arm 20 will not move or rotate with the lever means 14 beyond the transmission-engaged positions to the full throttle positions. However, transmission arm 20 remains in the transmission-engaged position.

The first connection means 26 further includes actuation means 29 for actuating the ball-detent means 27 in response to pivotal movement of the lever means 14. The actuation means 29 engages the ball-detent means 27 in the transmission-engaged positions and disengages the ball-detent means 27 from the transmission arm 20 in the full throttle positions.

The actuation means 29 includes a movable shift housing 32 actuated by the lever means 14. The movable shift housing 32 has a cylindrical male portion 34 disposed inside the female portion 22 of the transmission arm 20. The moving shift housing 32 further includes a bore 80 extending through the male portion 34 and a flange 82 at one end of the male portion 34.

The moving shift housing 32 also includes a key projection 86 keying the moving shift housing 32 inside the support housing 12. In other words, the key projection 86 of the moving shift housing 32 is displaced in a key way 88 of the housing 12 and rotated to prevent the moving shift housing 32 from moving axially along the lever axis A.

The ball-detent means 27 includes at least two, preferably three, rollers or roller balls 36, 36', 36" between the transmission arm 20 and the moving shift housing 32 for engagement of the moving shift housing 32 with the transmission arm 20 during the transmission-engaged positions. In other words, the lever means 14 rotates the moving shift housing 32 about the lever axis A, and the transmission arm 20 rotates with the moving shift housing 32 by engagement of the rollers 36, 36', 36" between the transmission arm 20 and the moving shift housing 32.

The ball-detent means 27 further includes a stationary shift housing 38 having a bore 40 extending through the stationary shift housing 38. The female portion 22 of the transmission arm 20 is rotatably disposed within the bore 40 of the stationary shift housing 38. The stationary shift housing 38 includes at least two, preferably three, detents 42, 42', 42" for receiving the displaced rollers 36, 36', 36" in the detents 42, 42', 42" to allow the moving shift housing 32 to rotate beyond either of the transmission-engaged positions to the full throttle positions. The transmission arm 20 also includes at least two, preferably three, slots 44, 44', 44" in the circumference of the female portion 22 of the transmission arm 20 for retaining the rollers 36, 36', 36" between the male portion 34 of the moving shift housing 32 and the stationary shift housing 38.

The moving shift housing 32 includes a first recess portion 46 engaging one of the rollers 36 during the transmission-engaged positions in response to pivotal movement of the lever means 14. The moving shift housing 32 also includes a second recess portion 48 having a leading wall 48' and a trailing wall 48" engaging the two remaining rollers 36', 36" during the transmission-engaged positions in response to pivotal movement of the lever means 14. Put another way, rollers 36, 36', 36" are disposed in the slots 44, 44', 44" of the female portion 22 of the transmission arm 20, and are retained in the slots 44, 44', 44" by engagement of the recess portions 46, 48 of the moving shift housing 32 encompassing part of the rollers 36, 36', 36" and engagement of the bore 40 of the stationary shift housing 38. The recess portion 46 encompasses one of the rollers 36, and the second recess portion 48 encompasses two of the rollers 36', 36".

In operation, as the lever means 14 rotates the moving shift housing 32 clockwise from the neutral position, the first recess portion 46 engages one roller 36 and the second recess portion 48 engages the two remaining rollers 36', 36" and moves the rollers 36, 36', 36" which, in turn, drive or rotate the female portion 22 of the transmission arm 20. When the transmission arm 20 is in the fully transmission-engaged position, roller 36 will be displaced into detent 42 of the stationary shift housing 38, and roller 36" will be displaced into detent 42" of the stationary shift housing 38. As the moving shift housing 32 continues to rotate through the full throttle position, roller 36 in the second recess portion 48 will not be displaced and remains in the slot 44' of the transmission arm 20 and the second recess portion 48 of the moving shift housing 32. The moving shift housing 32 continues to rotate to the full throttle position until the trailing or opposite wall 48" of the second recess portion 48 engages the roller 36' to act as a stop to prevent further rotation of the moving shift housing 32. After the moving shift housing 32 is rotated in the opposite direction or counterclockwise from the full throttle position to the idle position, the leading wall 48' of the second recess portion 48 will contact the roller 36' to engage and move the transmission arm 20 causing the two remaining rollers 36', 36" to move out of the detents 42, 42", respectively, of the stationary shift housing 38 moving the transmission arm 20 to the neutral position.

In the opposite direction, the lever means 14 rotates the moving shift housing 32 counterclockwise from the neutral position, which in turn, rotates the transmission arm 20 to the fully transmission-engaged position, e.g. reverse. When the transmission arm 20 is in the fully transmission-engaged position, roller 36 will be displaced into detent 42' of the stationary shift housing 38, and roller 36' will be displaced into detent 42'' of the stationary shift housing 38. As the moving shift housing 32 continues to rotate through the full throttle position, the roller 36'' in the second recess portion 48 will not be displaced and remains in the slot 44'' of the transmission arm 20 and the second recess portion 48 of the moving shift housing 32. The moving shift housing 32 continues to rotate to the full throttle position until the leading wall 48' of the second recess portion engages the roller 36'' to act as a stop to prevent further rotation of the moving shift housing 32. After the moving shift housing 32 is rotated clockwise from the full throttle position to the idle position, the trailing wall 48'' of the second recess portion 48 will contact roller 36'' to engage and move the transmission arm 20 causing the two remaining roller balls 36, 36'' to move out of the detents 42', 42'', respectively, of the stationary shift housing 38 moving the transmission arm 20 to the neutral position.

The assembly 10 further includes sound-generating means, generally indicated at 50, for generating an acoustic sound to signal the operator as to the position of the transmission arm 20. The sound-generating means 50 includes a leaf spring 52 and a spring roller 54 disposed between the leaf spring 52 and the transmission arm 20. The stationary shift housing 38 includes a curved slot 56 for retaining and biasing the leaf spring 52. The female portion 22 of the transmission arm 20 includes at least two, preferably three, recess portions 58, 58', 58'' retaining the spring roller 54 in either a fully transmission-engaged position or the neutral position. In other words, female portion 22 of the transmission arm 20 has three recess portions or detents 58, 58', 58'' for neutral 58', full forward 58, and fully reverse 58'' transmission-engaged positions. The spring roller 54 is retained in a slot 60 of the stationary shift housing 38. The leaf spring 52 is disposed within the slot 56 of the stationary shift housing 38. As the transmission arm 20 is rotated to either transmission-engaged position, the spring roller 54 is displaced against the leaf spring 52 and is held in the slot 60 until the transmission arm 20 rotates to the next detent or 58 or 58'' from the neutral position wherein the spring roller 54 is displaced into the detent 58 or 58'' generating a "clicking" noise. This acoustic sound signals the operator that the transmission arm 20 is in the next position.

The lever means 14 includes a lever 62 having a handle 64 extending transversely outwardly from the lever 62. The lever 62 includes a cylindrical shaft 66 disposed in the bore 80 of the moving shaft housing 32 for actuating the first connection means 26. The lever 62 further includes a cylindrical groove on the shaft 66 of the lever 62 having a smaller diameter than the shaft 66. The shaft 66 has a rectangular portion 70 and a projection 72 on the end of the rectangular portion 70.

The second connection means 28 includes a guide member 90 having a groove 91 and curved channel 92, follower means 94 for following the path of the channel 92 of the guide member 90, and connecting means 96 for connecting the throttle arm 16 to the follower means 94.

The follower means 94 includes a fuel drive member 98 connected to the rectangular portion 70 of the shaft 66 of the lever 62 having a cavity portion 100 and a flange member 102 extending outwardly perpendicular to the axis of the fuel drive member 98. The flange member 102 has an elongated slot 104 to allow lost motion between the throttle arm 16 and the first connection means 26 in response to pivotal movement of the lever means 14 in the transmission-engaged positions. The fuel drive member 98 further includes a rectangular slot 106 communicating through the cavity portion 100 engaging the rectangular portion 70 of the shaft 66 of the lever 62. The rectangular portion 70 extends through the slot 106 and the cavity portion 100 of the fuel drive member 98. The follower means 94 also includes a fuel drive connector 108 having a threaded bore 110 and a cylindrical shaft 112 disposed in the channel 92 of the guide member 90. A washer 114 interconnects the fuel drive connector 108 and the slot 104 of the fuel drive member 106, and a second washer 114 is disposed on the other side of flange 102 of the fuel drive member 98. A retaining cap 116 is fitted onto the shaft 112 of the fuel drive connector 108 and secures the fuel drive connector 108 to the flange 102 of the fuel drive member 98 while allowing the fuel drive connector 108 to move axially along the slot 104 of the fuel drive member 98.

The biasing means 30 includes engagement means 73 between the first connection means 26 and the lever means 14 for simultaneously rotating the moving shift housing 32 of the actuation means 29 in response to pivotal movement of the lever 62 of the lever means 14. The engagement means 73 may be disengaged in response to the lever means 14 being axially moved or disengaged from the first connection means 26 to allow the lever means 14 to be rotated independently of the first connection means 26.

The engagement means 73 includes key male projections on the lever 62, and a slot 82 extending diametrically across the flange 82 of the moving shift housing 32 for receiving the key male projections 74 in response to the lever means 14 being engaged with the first connection means 26 in an engaged position. Put another way, the key projections 74 or the lever 62 engage the slot 82 of the moving shift housing 32 in the engaged position to rotate the moving shift housing 32 about the lever or transmission arm axis.

The biasing means 30 further includes retaining means 75 for preventing axial movement of the lever means 14 in response to the lever means 14 being engaged with the first connection means 26 in an engaged position. The retaining means 75 includes a pin 76 disposed in a bore 78 in the moving shift housing 32. The retaining means 75 further includes a groove 68 in the shaft 66 of the lever 62 of smaller diameter than the shaft 66. When the lever means 14 is in the engaged position, the pin 76 which is partially disposed in the bore 78 engages the groove 68 of the lever 62. When the lever means 14 is axially biased in a disengaged position, the pin 76 moves out of the groove 68 and is displaced fully inside the bore 78 of the moving shift housing 32.

The biasing means 30 includes a spring 118 disposed around the rectangular portion 70 of the lever 62 and within the cavity portion 100 of the fuel drive member 98. The biasing means 30 also includes a washer 120 having a rectangular slot 122 mating with the rectangular portion 70 of the shaft 66 of the lever 62 for maintaining alignment of the axis of the spring 118. A retaining clip 124 is secured to the projection 72 of the shaft 66 of the lever 62. In operation, the lever 62 is displaced axially along the lever axis A and the spring 118 is biased to a fully compressed state to allow the projections 74 of the lever 62 to move out of the slot 84 of the moving shift housing 32.

The connecting means 96 includes a connecting rod 126 having a threaded end 128 threadably engaging the bore 110 of the fuel drive connector 108 and a bore 130 at the other end. The connecting means 96 also includes a fuel axle 132 securing the throttle arms 16 to the housing 12. A retaining clip 124 secures the fuel axle 132 to the support housing 12. The connecting means 96 further includes a linkage connector 134 having a shaft 135 and a slot 136 for receiving the free end of the connecting rod 126. The linkage connector 134 also includes a bore 133 perpendicular to the axis of the fuel linkage connector and aligned with the bore 130 of the connecting rod 126. A cotter pin 143 is disposed in the bore 133 and 130 to secure the linkage connector 134 to the connecting rod 126. The connecting means 96 also includes washers 114 on both sides of a bore 141 of the throttle linkage 16. A retaining clip 124 secures the shaft 135 of the linkage connector 134 which is disposed in the bore 141 to the throttle arm 16.

The channel 92 of the guide member 90 includes a dwell portion 134 arcuate about said throttle arm axis B and a guide portion 136 at each end of the dwell portion 134 being arcuate about the lever axis A. The follower means 94 acts as a cam follower in the channel 92 of the guide member 90. In operation, follower means 94 moves along the dwell portion 134 during the transmission-engaged position without throttle advancement to allow loss motion between the throttle linkage 16 and the fuel drive member 98. The guide portion 136 is oriented to actuate throttle advancement of the throttle arm 16 during the full throttle position.

The support housing 12 includes a control head 138 being tubular or cylindrical, and a control head plate 140 on each end of the control head 138 for mounting to a support surface. The support housing 12 being cylindrical in shape, is sandwiched in the vertical height of a cylindrical pedestal, as illustrated in FIG. 1. The support housing 12 further includes a bore 142 offset from center supporting the lever means 14. In other words, the moving shift housing 32 is disposed in the bore 142 of the control head 138 which in turn, supports the lever means 14. The control head 138 includes a throttle support member 148 having a bore 150 for receiving the fuel axle 132. The control head 138 further includes a shift housing member 152 for receiving the stationary shift housing 38 and having a bore 154. The control head 138 includes a member 156 having a tongue 158 which mates with the groove 91 of the guide member 90. Fasteners 144 disposed in the bores 146 secure the control head plate 140 to the control head 138. Fastener 144 disposed in bore 152 receives the stationary shift housing 38 to the control head 138. The guide member 90 is retained to the control head 138 between the control head plates 140 by engaging the tongue 158 of member 156 with the groove 91 of the guide member 90.

In operation, the lever 62 is normally in the neutral position. To engage the transmission, the handle 64 of the lever 62 is rotated clockwise for forward, and counterclockwise for the reverse transmission-engaged position. Once the transmission is engaged with the transmission arm 20 in the fully transmission-engaged position, the throttle may be advanced by further rotation of the handle 64 in the throttle positions. When the lever 62 is returned to the neutral position, the transmission is disengaged and the throttle is in idle, it being understood that the throttle remains in idle until after the transmission is engaged.

In order to "rev" the engine in the neutral position, the lever 62 is axially disengaged by moving the projections 74 on the lever 62 out of the slot 84 of the moving shift housing 32, and rotating the lever 62 so that the projections 74 rest on the flange 82 of the moving shift housing 32. Thus, the lever 62 is disengaged from the first connection means 26 allowing the throttle to advance without engagement of the transmission. The lever 62 will be in the engaged position for normal operation by returning the projections 74 of the lever 62 to the slot 84 of the moving shift housing 32.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is as follows:

1. A single lever control head assembly (10) for dual position shifting of a transmission and dual position throttle control of a motor comprising; a support housing (12), single lever handle means (14) pivotally supported by said housing (12) for rotation about a lever axis (A), a throttle arm (16) rotatably supported by said housing (12) for pivotal movement about a throttle arm axis (B) and including a throttle connection (18) moveable in an arc about said throttle arm axis (B) between an idle position and a full throttle position, a transmission arm (20) having a cylindrical female portion (22) rotatably supported by said housing (12) for pivotal movement about a transmission arm axis (A) and including a transmission connection (24) moveable in an arc about said transmission arm axis (A), said lever means (14) being pivotal in a first direction from a neutral position through a forward transmission-engaged position to a full forward throttle position and in an opposite second direction from the neutral position through a reverse transmission-engaged position to a full reverse throttle position, characterized by said transmission arm axis (A) and said lever axis (A) being coaxial, first connection means (26) disposed within said female portion (22) of said transmission arm (20) and rotatable about said transmission arm axis (A), for pivoting said transmission arm in an arc about said transmission arm axis (A) to said transmission-engaged positions during a first portion of pivotal movement of said lever means (14) from said neutral position to either of said transmission-engaged positions and for maintaining said transmission arm (20) in said transmission-engaged positions upon continued movement of said lever means (14) to either of said full throttle positions and for returning said transmission arm (20) to said neutral position with said lever means (14).

2. An assembly as set forth in claim 1 wherein said first connection means (26) includes ball detent means (27) for engaging and rotating said transmission arm (20) in response to pivotal movement of said lever means (14) during said transmission-engaged position and for disengaging said transmission arm (20) from said lever means (14) in response to pivotal movement of said lever means (14) beyond said transmission-engaged positions to said full throttle positions.

3. An assembly as set forth in claim 2 wherein first connection means (26) further includes actuation means (29) for actuating said ball detent means (27) in response to pivotal movement of said lever means (14), said actuation means (29) engaging said ball detent means (27) in said transmission-engaged positions and disengaging said ball detent means (27) from said transmission arm (20) in said full throttle positions.

4. An assembly as set forth in claim 3 wherein said ball detent means (27) includes at least two rollers (36) disposed between said transmission arm (20) and said actuation means (29), and a stationary shift housing (38) supported by said housing (12) having a bore (40) extending through said stationary shift housing (38), said female portion (22) of said transmission arm (20) rotatably disposed within said bore (40) of said stationary shift housing (38), said stationary shift housing including at least two detents (42) for receiving said rollers (36) in said detents (42) to allow said moving shift housing (32) to rotate beyond either of said transmission-engaged positions to said full throttle positions.

5. An assembly as set forth in claim 4 wherein said actuation means (29) includes a moving shift housing (32) having a first recess portion (46) engaging one of said rollers (36) during said transmission-engaged positions in response to pivotal movement of said lever means (14), and a second recess portion (48) engaging at least one of said roller balls (36) during said transmission-engaged positions in response to pivotal movement of said lever means (14).

6. An assembly as set forth in claim 5 wherein said transmission arm (20) includes at least two slots (44) in the circumference of said female portion (22) for retaining said rollers (36) between said moving male portion (34) of said shift housing (32) and said stationary shift housing (38).

7. An assembly as set forth in claim 6 further including biasing means (30) for biasing said lever means (14) axially into engagement with said first connection means (26) and for allowing disengagement from said first connection means (26) in both said full throttle positions and said transmission-engaged positions and allowing said lever means (14) to rotatably pivot in either direction for pivoting said throttle arm (16) in said full throttle position in response to pivotal movement of said lever means (14) beyond either of said transmission-engaged positions to said full throttle positions.

8. An assembly as set forth in claim 7 wherein said biasing means (30) includes engagement means (73) between said first connection means (26) sand said lever means (14) for simultaneously rotating said actuation means (29) in response to pivotal movement of said lever means (14) and for disengaging said lever means (14) from said first connection means (26) in response to said lever means (14) being axially disengaged from said first connection means (26) to allow said lever means (14) to be rotated independently of said first connection means (26).

9. An assembly as set forth in claim 8 wherein said engagement means (73) includes key male projection (74) on said lever means (14) and said moving shift housing having a female slot (84) extending diametrically across said moving shift housing (32) for receiving said key male projection (74) in response to said lever means (14) being engaged with said first connection means (26).

10. An assembly as set forth in claim 9 wherein said biasing means (30) further includes a spring (118), and retaining means (75) for preventing axial movement of said lever means (14) in response to said lever means (14) being engaged with said first connection means (26).

11. An assembly as set forth in claim 10 wherein said retaining means (75) includes a pin (76) mounted in said moving shift housing (32) and said lever means (14) includes a lever (62) having a cylindrical shaft (66) having a cylindrical groove (68) for engagement of said pin (76).

12. An assembly as set forth in claim 11 further including second connection means (28) for pivoting said throttle arm (16) in an arc about said throttle arm axis (B) to said full throttle position in response to pivotal movement of said lever means (14) beyond either of said transmission-engaged positions to said full throttle positions, and for preventing movement of said throttle arm (16) in an arc about said throttle arm axis to retain said throttle arm (16) in said idle position in response to pivotal movement of said lever means (14) between neutral and said transmission-engaged positions.

13. An assembly as set forth in claim 12 wherein said second connection means includes a guide member (90) having a curved channel (92), follower means (94) for following the path of said channel (92), and connecting means (96) for conecting said throttle arm (16) to said follower means (94).

14. An assembly as set forth in claim 13 wherein said channel (92) of said guide member (90) includes a dwell portion (134) arcuate about said throttle arm axis and a guide portion (136) at each end of said dwell portion (134) being concave about said lever axis.

15. An assembly as set forth in claim 14 wherein said follower means (94) includes a fuel drive member (98) connected to said shaft (66) of said lever (62) having a cavity portion (100) and a flange member (104) extending outwardly perpendicular to the axis (A) of said fuel drive member (98) having an elongated slot (104) to allow lost motion between said throttle arm (16) and said first connection means (26) in response to pivotal movement of said lever means (14) in said transmission-engaged positions, and a fuel drive connector (108) having a threaded bore (110) and a cylindrical shaft (112) disposed in said channel (92) of said guide member (90).

16. An assembly as set forth in claim 15 wherein said connecting means (96) includes a connecting rod (126) having a threaded end (128) threadably engaging said threaded bore (110) of said fuel drive connector (108), a fuel axle (132) securing said throttle arm (16) to said housing (12) and allowing pivotal movement of said throttle arm (16) about said throttle arm axis, and a linkage connector (134) connecting said connecting rod (126) to said throttle arm (16).

17. An assembly as set forth in claim 16 wherein said housing (12) includes a tubular control head (138) and a control head plate (140) on each end of said control head (138) for mounting to a support surface.

18. An assembly as set forth in claim 17 including sound generating means (50) for generating an acoustic sound to signal the operator as to the position of said transmission arm (20).

19. An assembly as set forth in claim 18 wherein said sound generating means (50) includes a leaf spring (52)

and a spring roller (54) disposed between said leaf spring (52) and said transmission arm (20).

20. An assembly as set forth in claim 19 wherein said female portion (22) of said transmission arm (20) includes at least two recess portions (58) retaining said spring roller (54) in said positions.

21. A single lever control head assembly (10) for dual position shifting of a transmission and dual position throttle control of a motor comprising; a support housing (12), a single lever handle means (14) pivotally supported by said housing (12) for rotation about a lever axis (A), a throttle arm (16) rotatably supported by said housing (12) for pivotal movement about a throttle arm axis (B) and including a throttle connection (18) moveable in an arc about said throttle arm axis (B) between an idle position and a full throttle position, a transmission arm (20) having a cylindrical female portion (22) rotatably supported by said housing (12) for pivotal movement about a transmission arm axis (A) and including a transmission connection (24) moveable in an arc about said transmission arm axis (A), said lever means (14) being pivotal in a first direction from a neutral position through a forward transmission-engaged position to a full forward throttle position and in an opposite second direction from the neutral position through a reverse transmission-engaged position to a full reverse throttle position, characterized by said support housing (12) being cylindrical with parallel ends for being sandwiched between a cylindrical pedestal (11) and having a transverse bore (142) offset from the center axis and supporting said lever means (14), said throttle arm (16) and said transmission arm (20) being disposed within said housing (12).

22. An assembly as set forth in claim 21 wherein said transmission arm axis (A) and said lever axis (A) are coaxial.

23. An assembly as set forth in claim 22 further including first connection means (26) disposed within said female portion (22) of said transmission arm (20) and rotatable about said transmission arm axis (A) for pivoting said transmission arm (20) in an arc about said transmission arm axis (A) to said transmission-engaged positions during a first portion of pivotal movement of said lever means (14) from said neutral position to either of said transmission-engaged positions and for maintaining said transmission arm (20) in said transmission-engaged positions upon continued movement of said lever means (14) to either of said full throttle positions and for returning said transmission arm (20) to said neutral position with said lever means (14).

* * * * *